US009318081B2

(12) United States Patent
Lyles

(10) Patent No.: US 9,318,081 B2
(45) Date of Patent: Apr. 19, 2016

(54) CONSTANT TENSION DEVICE

(71) Applicant: Intune Technologies, LLC, New York, NY (US)

(72) Inventor: Cosmos Lyles, New York, NY (US)

( * ) Notice: Subject to any disclaimer, the term of this patent is extended or adjusted under 35 U.S.C. 154(b) by 0 days.

(21) Appl. No.: 14/476,619

(22) Filed: Sep. 3, 2014

(65) Prior Publication Data

US 2015/0059550 A1 Mar. 5, 2015

Related U.S. Application Data

(60) Provisional application No. 61/873,295, filed on Sep. 3, 2013, provisional application No. 61/875,593, filed on Sep. 9, 2013.

(51) Int. Cl.
*G10D 3/14* (2006.01)
*G10D 1/08* (2006.01)

(52) U.S. Cl.
CPC ..... *G10D 3/14* (2013.01); *G10D 1/085* (2013.01); *G10D 3/143* (2013.01)

(58) Field of Classification Search
CPC ..... G10D 3/14; G10D 3/143
See application file for complete search history.

(56) References Cited

U.S. PATENT DOCUMENTS

| | | | | | |
|---|---|---|---|---|---|
| 16,995 | A | * | 4/1857 | Randle | 84/297 R |
| 1,416,568 | A | * | 5/1922 | Mazzocco | 84/297 R |
| 1,626,753 | A | * | 5/1927 | Carlson et al. | 84/297 R |
| 1,684,057 | A | * | 9/1928 | Fisher | 84/297 R |
| 2,070,916 | A | * | 2/1937 | Peate | 84/297 R |
| 2,130,248 | A | * | 9/1938 | Peate | 84/297 R |
| 2,298,611 | A | * | 10/1942 | Bruderlin | 244/233 |
| 2,453,572 | A | * | 11/1948 | Ferrier | 84/297 R |

(Continued)

FOREIGN PATENT DOCUMENTS

| | | |
|---|---|---|
| WO | WO 2006-023600 A2 | 3/2006 |
| WO | WO 2007-106600 A2 | 9/2007 |

OTHER PUBLICATIONS

International Search Report on related PCT Application No. PCT/US2014/053939 from International Searching Authority (KIPO) dated Dec. 11, 2014.

(Continued)

*Primary Examiner* — Robert W Horn
(74) *Attorney, Agent, or Firm* — Klein, O'Neill & Singh, LLP

(57) ABSTRACT

A support is configured to support and apply a constant or near-constant tension onto a wire or string, such as a musical string of a stringed musical instrument. The wire is attached to a carrier that moves axially. One or more springs operate between the carrier and a point that is fixed relative to the carrier and apply a transverse spring force to the carrier. A spring angle is defined between a line normal to the axis and a line of action of each spring. The transverse spring force can have an axial force component and an axial spring rate that is a function of the spring angle. The carrier can be positioned so that the axial spring rate is zero, negative or positive. A primary spring can apply a primary force directed coaxial with the wire. If the wire changes in length the primary force will correspondingly change, as will the axial force component. The transverse spring can be selected so that the axial force component of the transverse spring approximates the change in the force applied by the primary spring so that the axial force applied to the carrier and wire remains generally constant.

22 Claims, 12 Drawing Sheets

(56) References Cited

U.S. PATENT DOCUMENTS

| | | | | |
|---|---|---|---|---|
| 2,514,835 | A * | 7/1950 | Bredice | 84/297 R |
| 2,605,061 | A * | 7/1952 | Howe | 242/155 R |
| 3,667,336 | A * | 6/1972 | Itzler et al. | 84/454 |
| 4,909,126 | A * | 3/1990 | Skinn | G10G 7/02 84/454 |
| 5,018,700 | A * | 5/1991 | Hardtke | 248/571 |
| 5,040,741 | A * | 8/1991 | Brown | 242/128 |
| 5,095,797 | A * | 3/1992 | Zacaroli | 84/455 |
| 5,284,396 | A * | 2/1994 | Masumura et al. | 400/234 |
| 5,323,680 | A * | 6/1994 | Miller et al. | 84/455 |
| 5,377,926 | A * | 1/1995 | Min | 242/334.6 |
| 5,390,579 | A * | 2/1995 | Burgon | 84/454 |
| 5,477,765 | A * | 12/1995 | Dietzman | 84/313 |
| 7,479,592 | B1 * | 1/2009 | Slavik | G10D 3/146 84/312 R |
| 7,554,023 | B2 * | 6/2009 | Tyler | 84/313 |
| 7,855,330 | B2 * | 12/2010 | Lyles et al. | 84/297 R |
| 8,152,126 | B2 * | 4/2012 | Hardtke | 248/584 |
| 8,440,897 | B1 * | 5/2013 | Baxter | 84/454 |
| 8,779,258 | B2 * | 7/2014 | Lyles et al. | 84/297 R |
| 8,857,110 | B2 * | 10/2014 | Constantinou et al. | 52/167.4 |
| 2013/0220099 | A1 | 8/2013 | Lyles et al. | |
| 2015/0059550 | A1 * | 3/2015 | Lyles | 84/267 |

OTHER PUBLICATIONS

Written Opinion on related PCT Application No. PCT/US2014/053939 from International Searching Authority (KIPO) dated Dec. 11, 2014.

* cited by examiner

CONSTANT TENSION DEVICE

CROSS-REFERENCE TO RELATED APPLICATIONS

The application is based on and claims the benefit of U.S. Application Nos. 61/873,295, which was filed on Sep. 3, 2013 and 61/875,593, which was filed on Sep. 9, 2013, both of which are hereby incorporated by reference in their entirety.

BACKGROUND

The present disclosure relates to the field of devices for applying tension to a wire or string, and more specifically to devices that keep such tension at or near constant as the wire stretches or contracts over a limited range.

Various products and applications benefit from holding a wire or string at a near-constant, predictable tension over time and in a variety of environmental conditions. Notably, stringed musical instruments create music by vibrating strings held at tension. If the string is at the correct tension for the given instrument, it will vibrate at a desired frequency corresponding to the desired note. However, musical strings tend to stretch or contract over time and/or due to environmental factors such as temperature, humidity or the like. Such stretching or contracting typically results in the tension in the string changing, and the string thus vibrating at a different frequency than the desired frequency. This can result in the string going out of tune—emitting a note that is aurally different than the desired note. Typical stringed musical instruments tend to go out of tune fairly quickly, and musicians often find themselves spending substantial time tuning their instruments, even in the midst of performances.

The appearance of a musician's instrument looks is often seen as an expression of the artist, and thus musicians tend to desire that their instrument's componentry be non-obtrusive so as not to dominate the appearance. Also, certain instruments, particularly acoustic instruments, can be sensitive to componentry placed in certain portions of the instrument. Further, componentry should avoid possibly interfering with a musician during play.

SUMMARY

There is a need in the art for a method and apparatus for mounting a string of a stringed musical instrument in a manner so that the string remains at a near-constant tension even if the string stretches or contracts over time and/or due to environmental factors.

There is also a need in the art for such a method and apparatus that is relatively small and easy to install in certain stringed instruments without substantially altering sound of the instrument, altering its appearance, or interfering with playability.

In accordance with one embodiment, the present invention provides a constant tension device. The device includes a primary spring attached to a carrier so as to apply a primary spring force. The primary spring force applied to the carrier changes in accordance with a first function as the carrier moves relative to the primary spring along an axis. A wire or string is attached to the carrier and extends along the axis so that an axial force applied to the carrier is applied to the wire or string. A secondary spring has a first end attached to the carrier so as to apply a secondary spring force to the carrier. The secondary spring force is directed transverse to the axis and has an axial component that is applied to the carrier in a direction along the axis. The secondary spring force is configured so that the axial component of the secondary spring force varies in accordance with a second function as the carrier moves relative to the primary spring along the axis. A net axial force applied to the carrier comprises the sum of the primary spring force and the axial component of the secondary spring force.

In one such embodiment a stringed musical instrument comprises such a constant tension device, and the wire or string is a musical string having a first end attached to the carrier and a second end fixed relative to the carrier. The secondary spring is chosen so that as the carrier moves longitudinally along the axis the axial component of the secondary spring force changes in accordance with the secondary spring rate function, and the secondary spring rate function approximates and opposes the primary spring rate function so that the net axial force applied to the carrier stays within about 1.2% of a preferred tension per each millimeter of longitudinal movement. In another embodiment the secondary spring is chosen so that as the carrier moves longitudinally along the axis the axial component of the secondary spring force has a magnitude approximating the change in primary spring force applied to the carrier so that the net axial force applied to the carrier stays within about 0.6% of a preferred tension per each millimeter of longitudinal movement.

In another embodiment a second end of the secondary spring is fixed relative to the carrier, and a secondary spring angle is defined between a line normal to the axis and a line of action of the secondary spring. The carrier has an operational range defined as a distance along the axis between opposing first and second axial positions, the carrier being between the first and second axial positions. Some embodiments additionally comprise a first stop at the first axial position of the operational range, the first stop preventing the carrier from moving in a first direction past the first axial position. Some such embodiments additionally comprise a second stop at the second axial position of the operational range, the second stop preventing the carrier from moving in a second direction past the second axial position.

In other embodiments, the operational range corresponds to a change in the secondary spring angle up to 10°.

In one embodiment, the secondary spring force is directed in a direction normal to the axis at a point within the operational range. In additional embodiments the operational range is defined within a range in which the secondary spring angle is between ±5°.

In some embodiments a guitar includes such a constant tension device mounted to one of a headstock or a bridge of the guitar. A guitar string has a first end attached to the carrier and a second end attached to the other of the headstock and the bridge of the guitar. A tension in the guitar string is equal to the axial force applied to the carrier.

In some such embodiments, the carrier is movable to a position at which the guitar string is held at a perfect tune tension, and as the guitar string elongates the axial force applied to the carrier by the primary spring decreases and the axial component of force applied to the carrier by the secondary spring increases in the direction the carrier moves as the guitar string elongates.

In yet another embodiment of a guitar, a second end of the secondary spring is fixed relative to the carrier, and a secondary spring angle is defined between a line normal to the axis and a line of action of the secondary spring. The carrier has an operational range defined as a distance along the axis corresponding to a change in the secondary spring angle of up to 10°. The primary spring has a primary spring rate and the secondary spring has an axial spring rate component that opposes the primary spring rate so that a change in tension in the guitar string within the operational range corresponds to a range of 10 cents or less of frequency.

In additional embodiments the secondary spring comprises a pair of springs acting on opposite sides of the carrier, second ends of the secondary springs being fixed relative to the carrier. In some such embodiments the secondary springs can be rigidly connected to the carrier and to a fixed secondary spring mount.

In some embodiments the secondary springs comprise a flat sheet deflected in compression. In additional embodiments, the flat sheet is rigidly connected to the connector and a fixed secondary spring mount. In further embodiments, a plurality of the flat sheets are spaced apart from one another.

In still further embodiments, the pair of springs comprise deflected bars.

Some such embodiments additionally comprise a connector between each deflected bar and the carrier. In some embodiments the connector comprises an elongate bar. In other embodiments the connector comprises a ball bearing.

In accordance with yet another embodiment, a constant tension device is provided. The device includes a carrier configured to be movable along an axis and a wire or string attached to the carrier and extending along the axis so that an axial force applied to the carrier is communicated to the wire or string. A target tension is defined as a desired tension for the wire or spring. A spring has a first end attached to the carrier and a second end attached to a spring mount that is fixed relative to the carrier so that the spring applies a spring force to the carrier. A spring angle is defined between a line normal to the axis and a line of action of the spring. The spring force is directed transverse to the axis and has an axial force component and an axial spring rate that are communicated to the carrier in a direction along the axis. The spring is selected so that the axial force component equals the target tension when the spring angle is a zero rate angle at which the axial spring rate of the spring is zero.

In another embodiment, when the spring angle is greater than the zero rate angle the axial spring rate is one of negative or positive, and when the spring angle is less than the zero rate angle the axial spring rate is the other of negative or positive.

DESCRIPTION

The following description presents embodiments illustrating inventive aspects that are employed in a plurality of embodiments. It is to be understood that embodiments may exist that are not explicitly discussed herein, but which may employ one or more of the principles described herein. Also, these principles are primarily discussed in the context of stringed musical instruments. However, it is to be understood that the principles described herein can have other applications such as sporting goods, industrial and/or architectural applications in which it may be desired to apply a near-constant force to an item that may move over an operational range and/or employ spring arrangements that can exhibit positive spring rates.

This disclosure describes embodiments of a device that can apply a near-constant tension to a string, wire or the like even as that string, wire or the like changes in length over a range of distance. Notably, Applicant's U.S. Pat. No. 7,855,440, which is incorporated herein by reference in its entirety, teaches similar but distinct principles for achieving a near-constant tension in a wire or string as the wire or string expands and/or contracts.

Figure 1A:
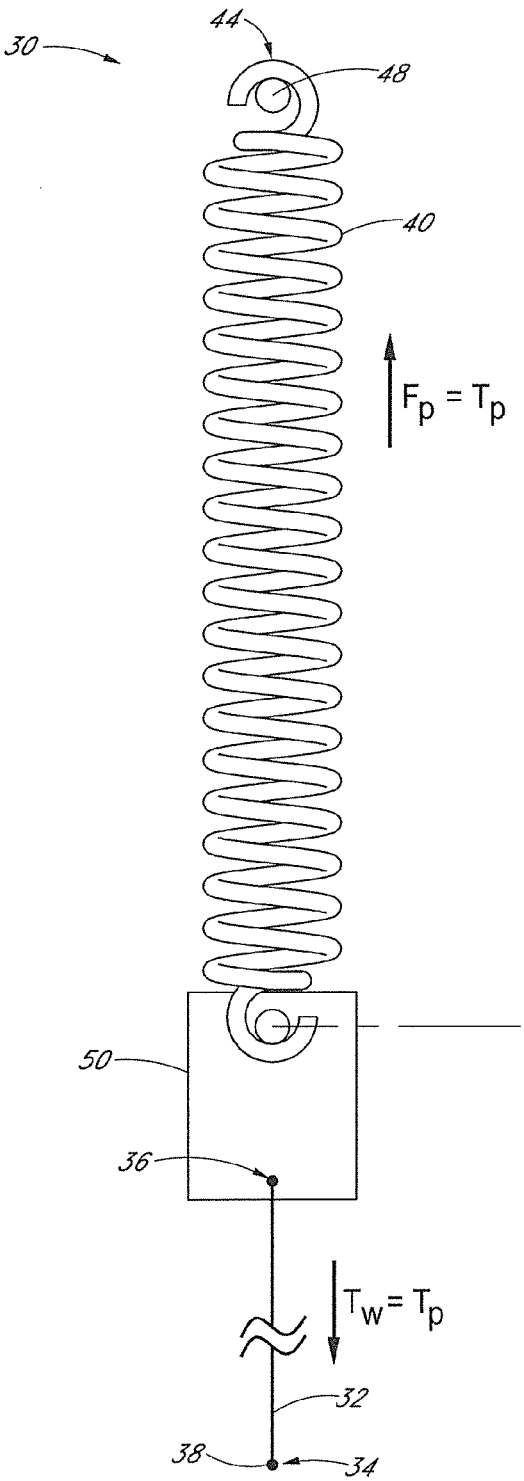
FIG. 1A shows a schematic representation of a spring arrangement.

With initial reference to FIG. 1A, a spring-based tension device 30 comprises a wire 32 that has a fixed end 34 and a movable end 36, and a primary spring 40 has a fixed end 42 and a movable end 44. The fixed end 34 of the wire 32 is mounted on a fixed wire mount 38; the fixed end 42 of the primary spring 40 is mounted on a fixed spring mount 48. The primary spring 40 has a spring constant k. The movable ends of the wire 32 and primary spring 40 are both attached at a carrier 50 (or attachment point) so that the primary spring 40 and wire 32 are coaxial. The primary spring 40 pulls on the wire 32 so that the force Fp in the primary spring 40 is identical to the tension Tw in the wire. In this embodiment, a preferred tension is Tp. In FIG. 1A, Fp=Tw=Tp.

Figure 1B:
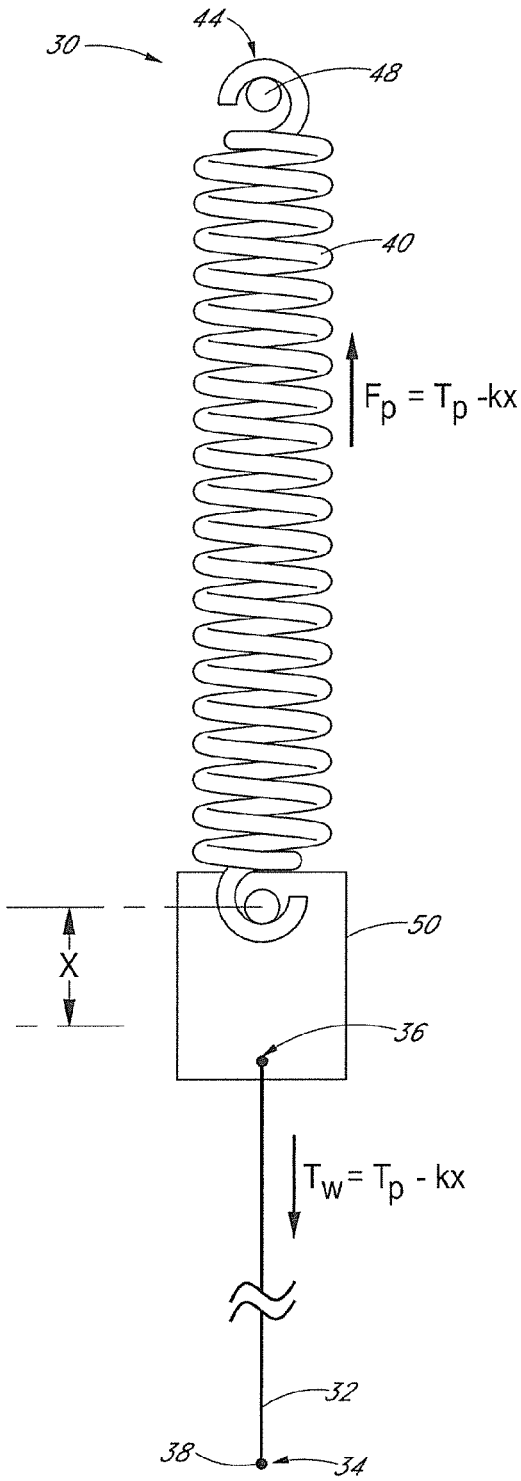
FIG. 1B shows the spring arrangement of FIG. 1A in a configuration in which a string has stretched.

Over time, the wire 32 may stretch or contract. FIG. 1B illustrates such a situation, as the wire 32 has stretched an axial distance x. Since the spring 40 follows Hooke's law, the force in the spring 40 is reduced by −kx, causing a corresponding change to the tension in the wire Tw. Thus, Fp=Tw=Tp−kx. As such, the tension in the wire 32 is no longer at the preferred tension Tp. Notably, Hooke's law (F=−kx) is a linear function.

Figure 2B:
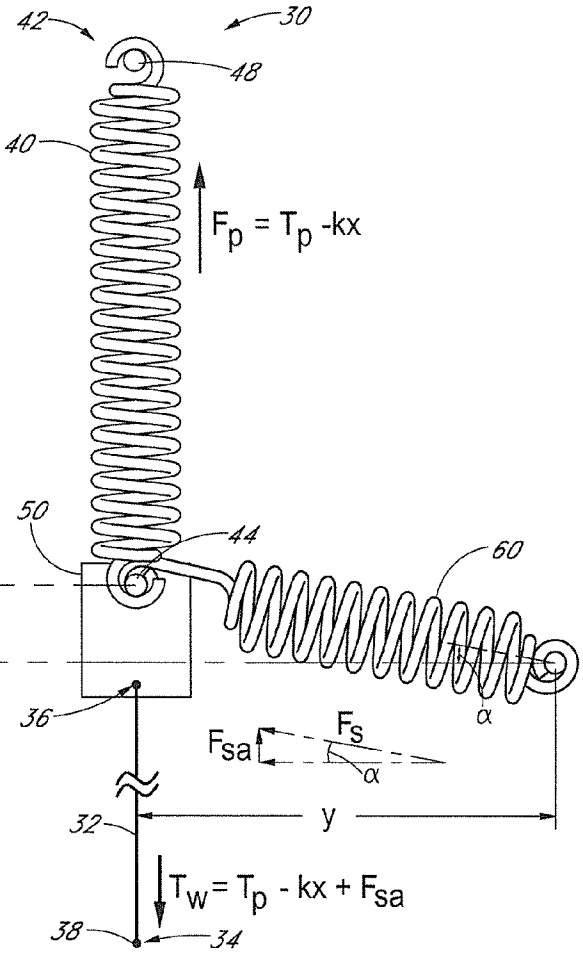
FIG. 2B shows the spring arrangement of FIG. 2A in a configuration in which a string has stretched.
Figure 2A:
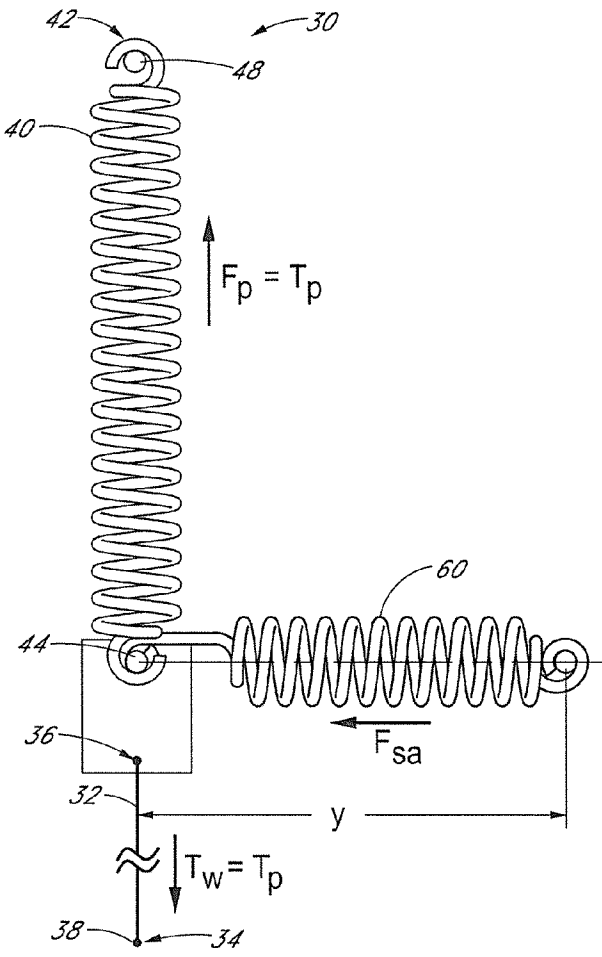
FIG. 2A shows a schematic representation of a spring arrangement in accordance with one embodiment.

FIGS. 2A-B illustrate another embodiment of a spring-based tension device 30 for maintaining the tension in the wire 32 at or near the preferred tension Tp. A secondary spring 60 has a fixed end 62 and a movable end 44. The fixed end 62 is attached to a secondary spring mount 68. The movable end 64 of the secondary spring 60 is attached to the movable ends 36, 44 of the primary spring 40 and wire 32 at the carrier 50. As shown in FIG. 2A, the secondary spring 60 exerts a force Fs which, in the initial position shown in FIG. 2A, is directed normal to the force Fp as applied by the primary spring 60 to the wire. Two. Preferably the carrier 50 is constrained so as to move only along a path that is coaxial with the primary spring 40 and the wire 32. Since Fs is directed normal to the attachment point in FIG. 2A, Fs has a vector force component Fsa of zero (0) along the axis. As such, secondary spring force Fs does not affect Tw.

Table 1 below presents a spreadsheet that demonstrates a real-life scenario of performance of one embodiment having structure as depicted in FIGS. 2A-2B. In the scenario depicted in Table 1, primary spring 40 (Spring 1), secondary spring 60 (Spring 2) and string 32 are attached as represented in FIGS. 2A-B. The primary spring (Spring 1) has a spring rate (k1) of 64 pounds per inch. The secondary spring (Spring 2) is in compression and has a spring rate (k2) of 10 lb./in. The range of travel of the attachment point (carrier 50) is 0.0625 in. In this embodiment the secondary spring (Spring 2) has an initial length y of 0.3 in. and is compressed to have an initial tension (Fs) of 19.7 lb. In this scenario, the initial position of the secondary spring 60 is normal to the primary spring 40.

TABLE 1

| Spring 1 Length | Fp | Spring 2 Length | Fs | Theta (rad) | Fsa | Tw | % Tw change | Theta (deg) | alpha (deg) |
|---|---|---|---|---|---|---|---|---|---|
| 1.4000 | 10.0000 | 0.3000 | 19.7000 | 1.5708 | 0.0000 | 10.0000 | 0.0000 | 90.0000 | 0.0000 |
| 1.3938 | 9.6000 | 0.3001 | 19.6993 | 1.5916 | 0.4103 | 10.0103 | 0.1031 | 91.1935 | 1.1935 |
| 1.3875 | 9.2000 | 0.3003 | 19.6974 | 1.6124 | 0.8200 | 10.0200 | 0.2001 | 92.3859 | 2.3859 |
| 1.3813 | 8.8000 | 0.3006 | 19.6941 | 1.6332 | 1.2285 | 10.0285 | 0.2849 | 93.5763 | 3.5763 |
| 1.3750 | 8.4000 | 0.3010 | 19.6896 | 1.6539 | 1.6351 | 10.0351 | 0.3513 | 94.7636 | 4.7636 |
| 1.3688 | 8.0000 | 0.3016 | 19.6838 | 1.6746 | 2.0394 | 10.0394 | 0.3936 | 95.9469 | 5.9469 |
| 1.3625 | 7.6000 | 0.3023 | 19.6767 | 1.6952 | 2.4406 | 10.0406 | 0.4059 | 97.1250 | 7.1250 |
| 1.3563 | 7.2000 | 0.3032 | 19.6683 | 1.7156 | 2.8383 | 10.0383 | 0.3827 | 98.2971 | 8.2971 |
| 1.3500 | 6.8000 | 0.3041 | 19.6586 | 1.7359 | 3.2319 | 10.0319 | 0.3186 | 99.4623 | 9.4623 |
| 1.3438 | 6.4000 | 0.3052 | 19.6477 | 1.7561 | 3.6208 | 10.0208 | 0.2085 | 100.6197 | 10.6197 |
| 1.3375 | 6.0000 | 0.3064 | 19.6356 | 1.7762 | 4.0048 | 10.0048 | 0.0476 | 101.7683 | 11.7683 |

With reference next to FIG. 2B, as discussed above in connection with FIG. 1B, over time the wire 32 may stretch, resulting in a reduction (by kx) of the primary force Fp applied by the primary spring 40 to the wire 32. However, since the carrier 50 moves along the axis a distance x, the secondary spring 60 is rotated an angle $\alpha$ about its fixed end 62. The secondary force Fs is no longer directed normal to the axis, but has an axial vector component (Fsa) determined by the equation Fs(sin $\alpha$). As such, the tension in the wire is calculated as Tw=Tp−kx+Fs(sin $\alpha$). Note that Fsa can also be determined by Fs(cos $\theta$), thus Tw=Tp−kx+Fs(cos $\theta$).

At relatively low angles of $\alpha$, such as from about 0-20°, more preferably 0-15°, still more preferably 0-10° and most preferably 0-5°, sin $\alpha$ is a substantially linear function. As noted above, −kx is a totally linear function, in which the primary spring rate k is a constant, and the function is negative. Thus, over such relatively low angles of $\alpha$, a secondary spring force Fs can be chosen so that over an operating range of deflection (x), the value of a function k(s)x is approximated by Fs(sin $\alpha$), and a secondary axial spring rate k(s) changes with $\alpha$ and the spring rate function is positive. As such, over the operating range shown in FIG. 2B, as the wire 32 elongates, the force Fp applied by the primary spring 40 decreases, but the axial force component Fsa of the force Fs applied by the secondary spring correspondingly increases, and is directed in the same axial direction as the primary force. As a result, the total tension on the wire Tw remains at or near the preferred tension Tp. Notably, the secondary axial spring rate k(s) at these ranges of $\alpha$ is positive, opposing the negative primary spring rate. Thus, if the wire of FIG. 2B were to contract in length such that $\alpha$ became negative, the tension force applied by the primary spring Fp would increase, but the compressive axial force component Fsa of the force Fs applied by the secondary spring would be directed opposite Fp and have a similar value. As a result, the total tension on the wire Tw would remain at or near the preferred tension Tp.

In the scenario depicted in Table 1, the tension Fp initially in primary spring (Spring 1)—and thus the preferred tension Tp in the wire—is 10 lb., and the initial length L1 of the primary spring 40 is 1.4 in. The spreadsheet simulates an application such as a guitar in which the springs apply the tension to a guitar string, and over time the guitar string stretches (here over a range of travel of 0.0625 in.). The spreadsheet shows the state of the springs and tension in the wire/guitar string at various points along the 0.0625 range of travel.

As shown in FIGS. 2A-2B and as represented in Table 1, as the string 32 stretches, the carrier 50 and associated attachment point moves. As a result, the primary spring 40 (Spring 1) decreases in length a distance x and the primary force Fp correspondingly decreases. However, secondary spring 60 (Spring 2) rotates, thus increasing the axially-directed component force Fsa, which is computed as Fs cos $\theta$ or Fs sin $\alpha$. Notably, the length L2 of spring 2 will change slightly with the rotation (computed as ((y^2+x^2)^½), and thus Fs will change slightly due to the Spring 2 spring rate.

In the scenario depicted in Table 1, over a string stretch of 0.0625 in., secondary spring 60 (Spring 2) rotates almost 12 degrees, and the total tension in the wire (Tw) varies from the preferred (initial) tension Tp by at most about 0.4%. Such a variance would result in minimal, if any, audible changes in guitar string tune.

It is to be understood that various lengths, spring rates, etc. can be selected for the primary and secondary springs in order to vary specific results, but the principle remains that the secondary spring is chosen to approximate the linear change in tension applied by the primary spring as the primary spring moves linearly and the secondary spring (or at least the line of action of the secondary spring) changes such that the rate of change of the axially-directed component force approximately negates the rate of change of the primary spring force.

Figure 3:
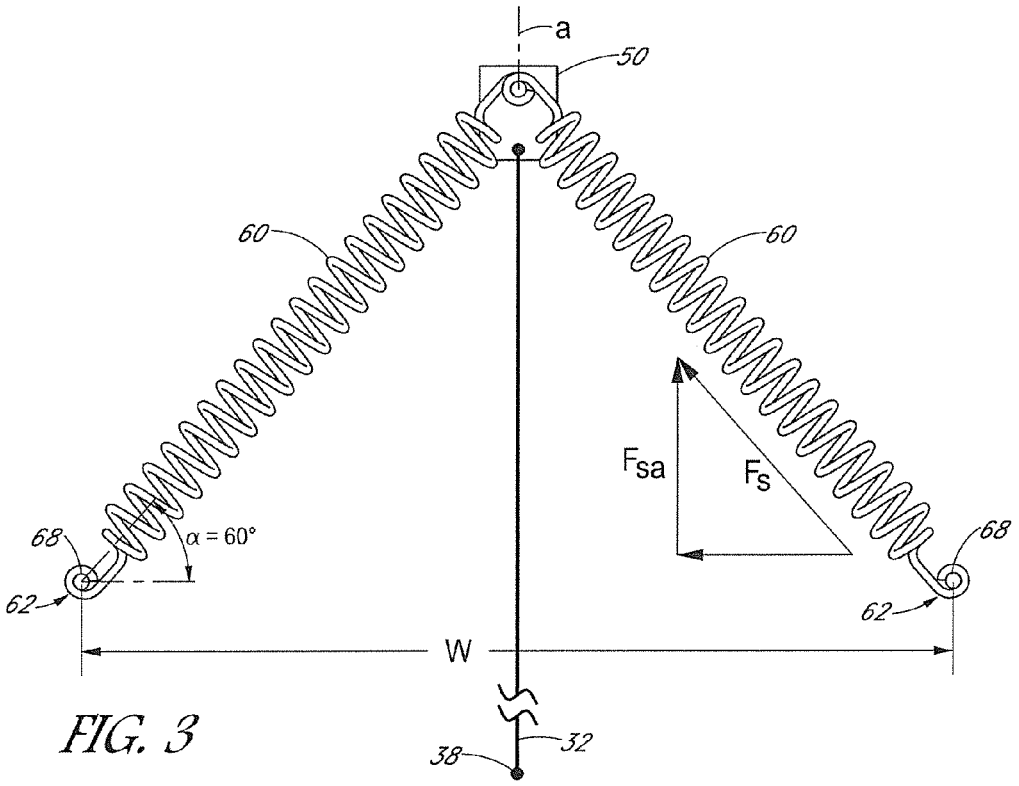
FIGS. 3-5 show a schematic representation of a spring arrangement in accordance with another embodiment, shown at three positions.

With reference next to FIG. 3, in another embodiment, opposing spring mounts 68 are fixed relative one another and are spaced a width w from one another. A pair of identical springs 60 are provided, with a fixed end 62 of each spring attached to a respective one of the fixed spring mounts 68 and a movable end before attached to a carrier 50 that is configured to translate linearly along an axis a. As shown, the springs 60 preferably are arranged symmetrically about the axis. A wire 32 or the like can be attached to the carrier 50.

In the embodiment illustrated in FIG. 3, each spring 60 has an angle α relative to a line normal to the axis a. In FIG. 3, α=60°. With additional reference to FIGS. 4 and 5, and also reference to Table 2 below, as the carrier 50 moves along the axis, the angle α decreases, as does the length of the springs 60 and axial force component Fsa of each spring, as the springs are placed into compression. Still further, as demonstrated in Table 2, the effective spring rate of each spring XP along the axis also changes with α.

In Table 2 below, an example is presented in which the springs 60 are initially arranged so that α=60°, and the at-rest length of the springs is 2.0 in. The example spring has a spring rate k of 90 lb./in. and the width w between the fixed spring mounts 68 is 2.0 in., so that each fixed spring mount is 1.0 in. from the axis. Table 2 shows how various aspects of this arrangement change as the carrier 50 moves linearly along the axis as demonstrated in FIGS. 3-5. Specifically, as α decreases, the length L of each spring decreases, and each spring is placed into compression, exerting spring force Fs. The spring force can be broken into components, including the axial component of force Fsa. With each decrease of one degree of α there is a corresponding incremental change in axial distance moved by the carrier 50. The axial force Fsa divided by the incremental axial distance indicates an axial spring rate ka at that point along the movement of the springs. Thus, as shown in Table 2, the axial spring rate changes with α.

TABLE 2

| Alpha (deg) | Length L | Spring Force F | Axial Force Fa | Axial distance | Axial Spring Rate ka |
|---|---|---|---|---|---|
| 60 | 2.0000 | 0.0000 | 0.0000 | | |
| 59 | 1.9416 | 5.2556 | 4.5050 | 0.0678 | −66.4730 |
| 58 | 1.8871 | 10.1628 | 8.6185 | 0.0639 | −64.3302 |
| 57 | 1.8361 | 14.7529 | 12.3729 | 0.0605 | −62.0859 |
| 56 | 1.7883 | 19.0538 | 15.7963 | 0.0573 | −59.7414 |
| 55 | 1.7434 | 23.0898 | 18.9140 | 0.0544 | −57.2983 |
| 54 | 1.7013 | 26.8829 | 21.7487 | 0.0518 | −54.7586 |
| 53 | 1.6616 | 30.4524 | 24.3204 | 0.0493 | −52.1245 |
| 52 | 1.6243 | 33.8158 | 26.6472 | 0.0471 | −49.3986 |
| 51 | 1.5890 | 36.9886 | 28.7455 | 0.0450 | −46.5837 |
| 50 | 1.5557 | 39.9849 | 30.6302 | 0.0431 | −43.6832 |
| 49 | 1.5243 | 42.8172 | 32.3146 | 0.0414 | −40.7003 |
| 48 | 1.4945 | 45.4971 | 33.8109 | 0.0398 | −37.6391 |
| 47 | 1.4663 | 48.0349 | 35.1305 | 0.0382 | −34.5034 |
| 46 | 1.4396 | 50.4399 | 36.2834 | 0.0368 | −31.2976 |
| 45 | 1.4142 | 52.7208 | 37.2792 | 0.0355 | −28.0263 |
| 44 | 1.3902 | 54.8853 | 38.1265 | 0.0343 | −24.6944 |
| 43 | 1.3673 | 56.9405 | 38.8333 | 0.0332 | −21.3069 |
| 42 | 1.3456 | 58.8931 | 39.4071 | 0.0321 | −17.8692 |
| 41 | 1.3250 | 60.7488 | 39.8548 | 0.0311 | −14.3866 |
| 40 | 1.3054 | 62.5133 | 40.1828 | 0.0302 | −10.8650 |
| 39 | 1.2868 | 64.1916 | 40.3971 | 0.0293 | −7.3103 |
| 38 | 1.2690 | 65.7884 | 40.5034 | 0.0285 | −3.7283 |
| 37 | 1.2521 | 67.3078 | 40.5068 | 0.0277 | −0.1255 |
| 36 | 1.2361 | 68.7539 | 40.4125 | 0.0270 | 3.4919 |
| 35 | 1.2208 | 70.1303 | 40.2251 | 0.0263 | 7.1174 |
| 34 | 1.2062 | 71.4404 | 39.9490 | 0.0257 | 10.7445 |
| 33 | 1.1924 | 72.6873 | 39.5883 | 0.0251 | 14.3665 |
| 32 | 1.1792 | 73.8739 | 39.1472 | 0.0245 | 17.9767 |
| 31 | 1.1666 | 75.0030 | 38.6294 | 0.0240 | 21.5683 |
| 30 | 1.1547 | 76.0770 | 38.0385 | 0.0235 | 25.1345 |
| 29 | 1.1434 | 77.0981 | 37.3779 | 0.0230 | 28.6686 |

TABLE 2-continued

| Alpha (deg) | Length L | Spring Force F | Axial Force Fa | Axial distance | Axial Spring Rate ka |
|---|---|---|---|---|---|
| 28 | 1.1326 | 78.0687 | 36.6510 | 0.0226 | 32.1636 |
| 27 | 1.1223 | 78.9906 | 35.8610 | 0.0222 | 35.6128 |
| 26 | 1.1126 | 79.8658 | 35.0109 | 0.0218 | 39.0094 |
| 25 | 1.1034 | 80.6960 | 34.1036 | 0.0214 | 42.3467 |
| 24 | 1.0946 | 81.4827 | 33.1420 | 0.0211 | 45.6182 |
| 23 | 1.0864 | 82.2276 | 32.1289 | 0.0208 | 48.8171 |
| 22 | 1.0785 | 82.9319 | 31.0668 | 0.0204 | 51.9372 |
| 21 | 1.0711 | 83.5970 | 29.9585 | 0.0202 | 54.9721 |
| 20 | 1.0642 | 84.2240 | 28.8063 | 0.0199 | 57.9157 |
| 19 | 1.0576 | 84.8141 | 27.6128 | 0.0196 | 60.7619 |
| 18 | 1.0515 | 85.3684 | 26.3803 | 0.0194 | 63.5048 |
| 17 | 1.0457 | 85.8877 | 25.1111 | 0.0192 | 66.1389 |
| 16 | 1.0403 | 86.3731 | 23.8076 | 0.0190 | 68.6587 |
| 15 | 1.0353 | 86.8251 | 22.4720 | 0.0188 | 71.0590 |
| 14 | 1.0306 | 87.2448 | 21.1064 | 0.0186 | 73.3347 |
| 13 | 1.0263 | 87.6326 | 19.7131 | 0.0185 | 75.4812 |
| 12 | 1.0223 | 87.9893 | 18.2940 | 0.0183 | 77.4939 |
| 11 | 1.0187 | 88.3155 | 16.8514 | 0.0182 | 79.3685 |
| 10 | 1.0154 | 88.6116 | 15.3872 | 0.0181 | 81.1013 |
| 9 | 1.0125 | 88.8781 | 13.9036 | 0.0179 | 82.6884 |
| 8 | 1.0098 | 89.1155 | 12.4025 | 0.0178 | 84.1266 |
| 7 | 1.0075 | 89.3241 | 10.8859 | 0.0178 | 85.4127 |
| 6 | 1.0055 | 89.5043 | 9.3557 | 0.0177 | 86.5442 |
| 5 | 1.0038 | 89.6562 | 7.8141 | 0.0176 | 87.5185 |
| 4 | 1.0024 | 89.7802 | 6.2628 | 0.0176 | 88.3336 |
| 3 | 1.0014 | 89.8765 | 4.7038 | 0.0175 | 88.9878 |
| 2 | 1.0006 | 89.9451 | 3.1390 | 0.0175 | 89.4797 |
| 1 | 1.0002 | 89.9863 | 1.5705 | 0.0175 | 89.8082 |
| 0 | 1.0000 | 90.0000 | 0.0000 | 0.0175 | 89.9726 |
| −1 | 1.0002 | 89.9863 | −1.5705 | 0.0175 | 89.9726 |
| −2 | 1.0006 | 89.9451 | −3.1390 | 0.0175 | 89.8082 |
| −3 | 1.0014 | 89.8765 | −4.7038 | 0.0175 | 89.4797 |
| −4 | 1.0024 | 89.7802 | −6.2628 | 0.0175 | 88.9878 |
| −5 | 1.0038 | 89.6562 | −7.8141 | 0.0176 | 88.3336 |

Figure 4:
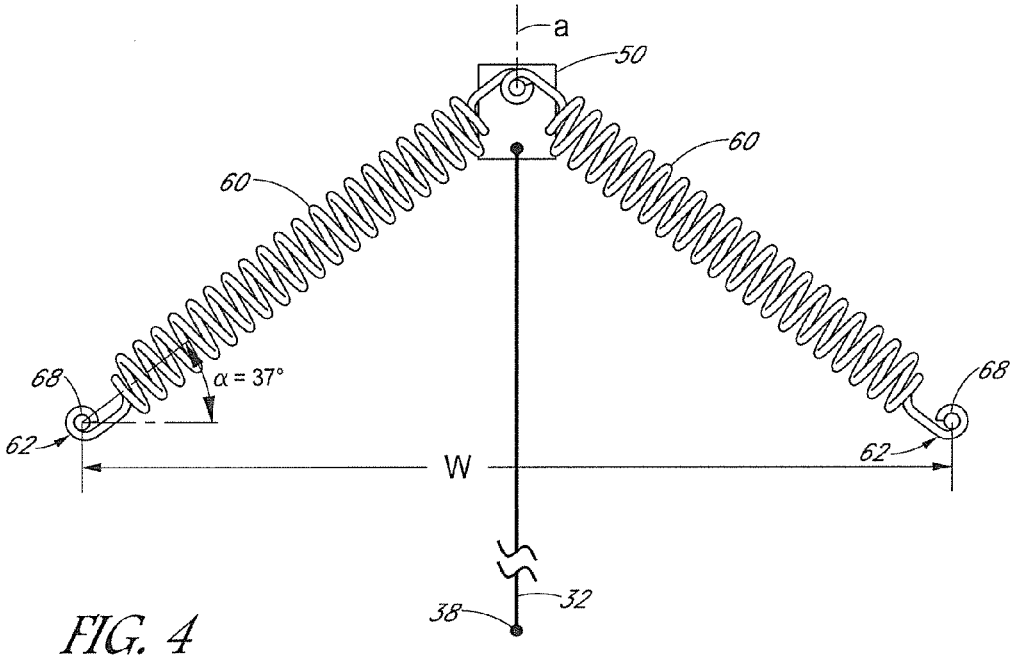
Figure 5:
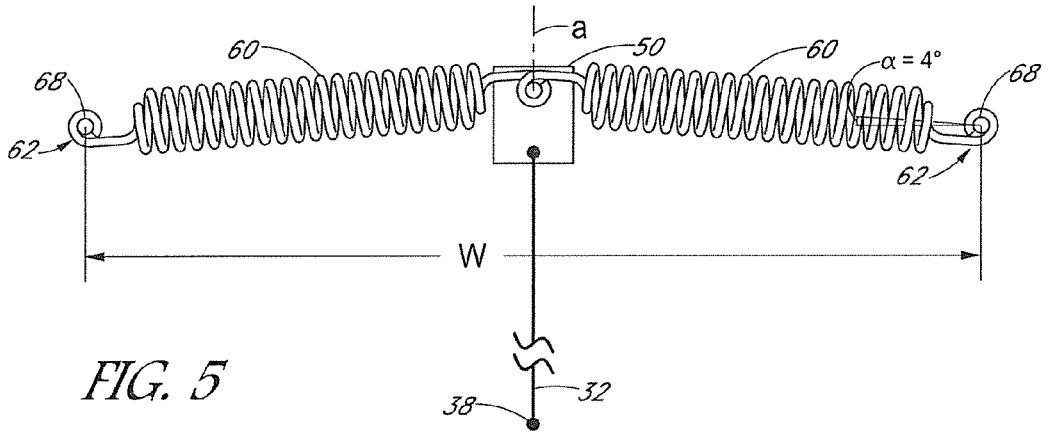

With specific reference next to FIG. 4 and Table 2, when α is about 37°, the incremental axial spring rate transitions from a negative spring rate to a positive spring rate. Also, with reference to FIG. 5 and Table 2, the incremental spring rate that angles near α=0° is nearly constant and, in the illustrated embodiment, positive. More specifically, in the zone around α=0° from about α=5° to α=−5°, the spring rate is generally constant.

Figure 6:
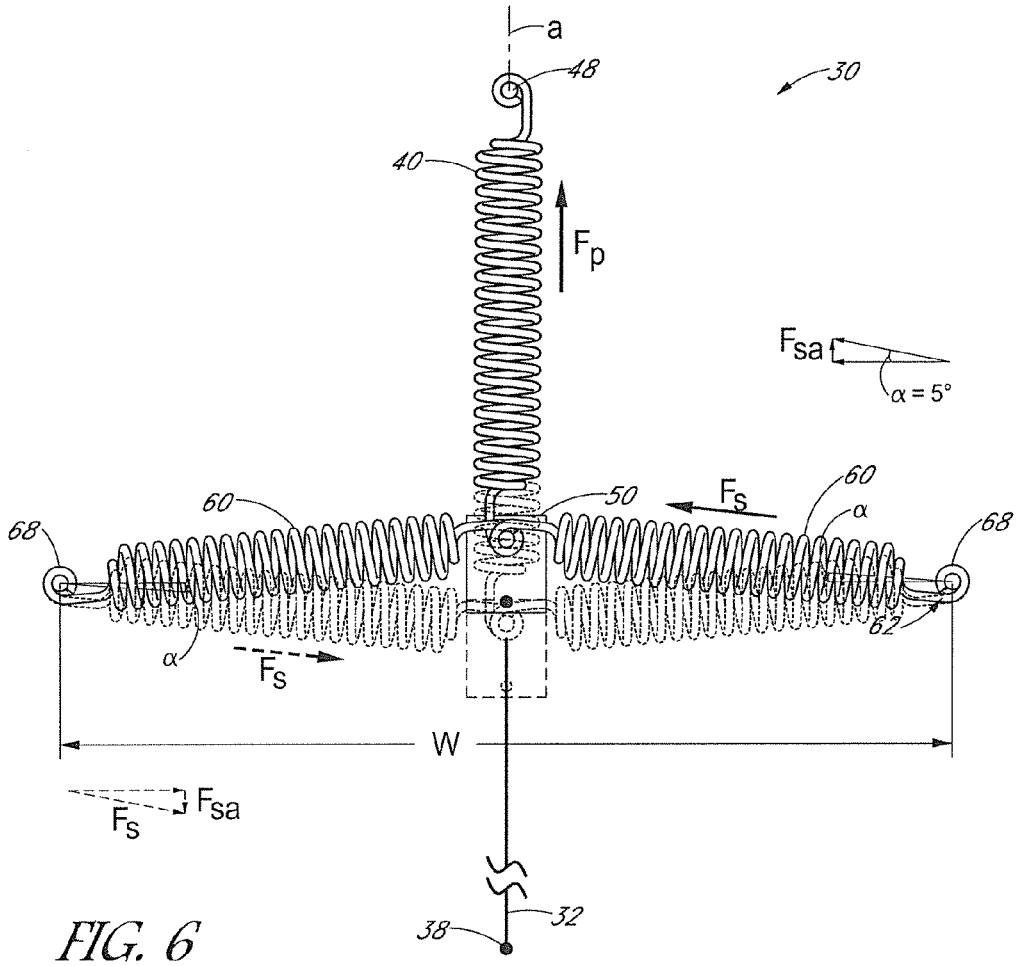
FIG. 6 shows a schematic representation of another spring arrangement in accordance with yet another embodiment.

With reference next to FIG. 6, in another embodiment, a primary, axially-directed spring 40 is attached to the carrier 50 and adapted to supply a primary spring force Fp to a wire 32, which is also attached to the carrier 50, in a manner similar to the embodiment of FIG. 2. In FIG. 6, opposing identical secondary springs 60 are arranged as the springs 60 are in FIGS. 3-5. In this embodiment, the primary spring 40 follows Hooke's law and thus has a constant spring rate k. As shown, the secondary springs 60 are disposed in a range of α=0±5°, in which the axial component of Force Fsa of the secondary springs 60 is a function of sin α, which is a nearly-linear function at small angles such as α=0±5°. As such, in a preferred embodiment, the secondary springs 60 can be selected to have a spring constant so that their axial force component Fsa generally follows and compensates for the linear reduction of the primary axial spring force Fp as the carrier 50 moves axially when the wire 32 (or musical string in some embodiments) stretches or contracts over time. As such, the tension Tw in the wire 32 remains generally the same during such stretching or contracting. In a preferred embodiment, such force compensation operates within an operational range, such as α=0±5°. Depending on the requirements of the application, the operational range may be narrower, such as α=0±3°, or larger, such as within α=0±10°, α=0±15°, or even α=0±20°.

With continued reference to FIG. 6 and reference again to Table 2, in a preferred embodiment, since the spring rate of each secondary spring 60 at and around α=0° approaches 90 lb./in., the total spring rate of the two secondary springs 60 combined approaches 180 lb./in. In one such embodiment, the primary spring 40 is selected to have a spring rate of −180 lb./in. As such, in the operational range of about α=0° relative to the opening, the primary spring 40 has a spring rate of about −180 lb./in. in tension, while the secondary springs combine to provide an axial spring rate in compression of about 180 lb./in. The combined spring rate, then, approaches zero, which results in the change in force applied by the tension device 30 approaching zero in the operational range about α=0°.

More specifically, in the embodiment depicted in FIG. 6 and Table 2, when the carrier 50 moves from α=0° to α=1°, it moves axially 0.017455 in. Thus, the tension applied by the primary spring 40 reduces by (180 lb./in)(0.017455 in.)=3.1419 lb. However, the axial component Fsa of force provided by the two secondary springs 60 is 2(1.57048 lb.)=3.1410 lb. Thus, the net change in tension as the carrier 50 moves from α=0° to α=1° is only 0.0009 lb. With additional reference to Table 3, the net axial spring rate ka for α=0±5° is calculated by adding the combined axial spring rate of the secondary springs 60 to the primary spring rate (here 180 lb./in.).

TABLE 3

| Alpha (deg) | Net Spring Rate |
|---|---|
| 5 | −4.9630 |
| 4 | −3.3328 |
| 3 | −2.0244 |
| 2 | −1.0407 |
| 1 | −0.3837 |
| 0 | −0.0548 |
| −1 | −0.0548 |
| −2 | −0.3837 |
| −3 | −1.0407 |
| −4 | −2.0244 |
| −5 | −3.3328 |

In view of Table 3, over a range of α=−4° to 4°, the net axial spring rate ka averages about −1.15 lb./in. Over a range of a range of α=−5° to 4°, the net axial spring rate averages about −1.37 lb/in. Over a range of α=−5° to 5°, the net axial spring rate averages about −1.69 lb./in.

Figure 7:
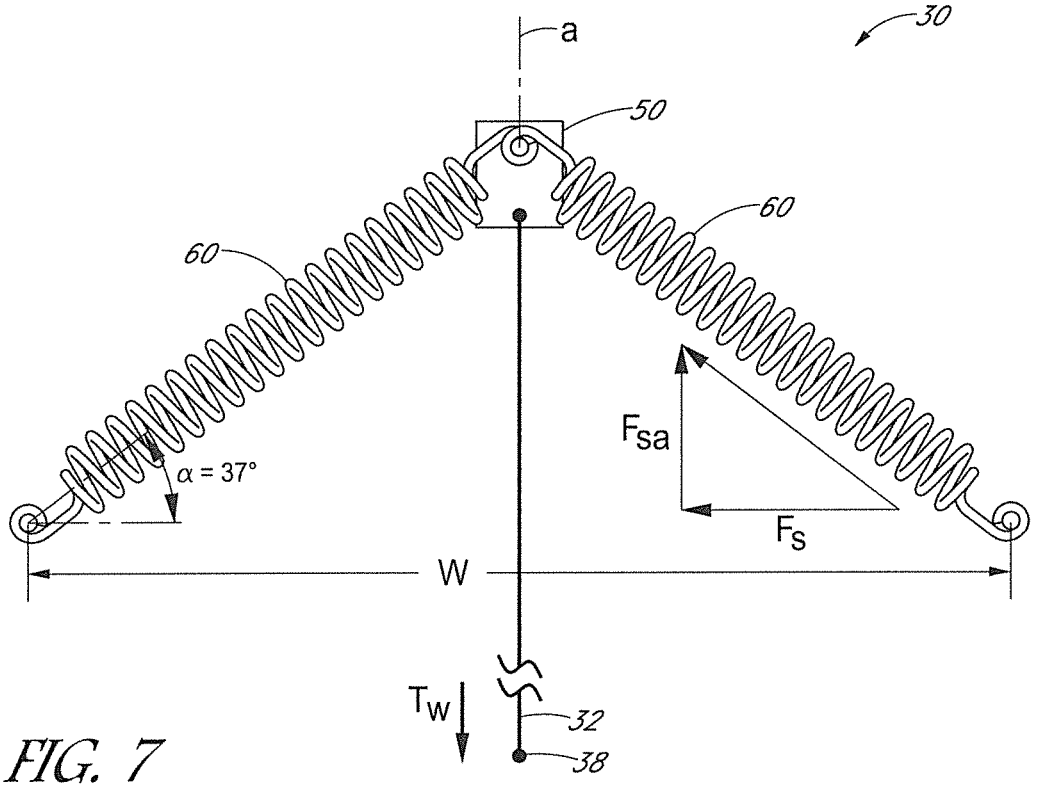
FIG. 7 shows a schematic representation of still another spring arrangement in accordance with another embodiment.

With reference next to FIG. 7, in another embodiment the operational range of a spring-based tension device 30 can be arranged to straddle the zone of zero spring rate, at which the spring rate transitions from a negative spring rate to a positive spring rate. Since the magnitude of spring rate reverses in this range, the net average spring rate can be constrained within a desired range. As such, the change in the net axial force component of the secondary springs in the operational range encompassing the zero spring rate transition can approximate the change in primary spring force as the carrier moves through this zone. An operational range thus can be defined about the angle corresponding to the point of zero spring rate. In the embodiment described in the table, the spring rate approaches zero at about α=37°. In some embodiments an operational range is defined ±1°, ±2°, ±4°, α=0±5−7° or about ±10° about the angle of zero spring rate. At the position of zero spring rate, incremental changes in axial position incur no change in force applied. Thus only the springs 60 are needed in this embodiment.

Figure 8B:
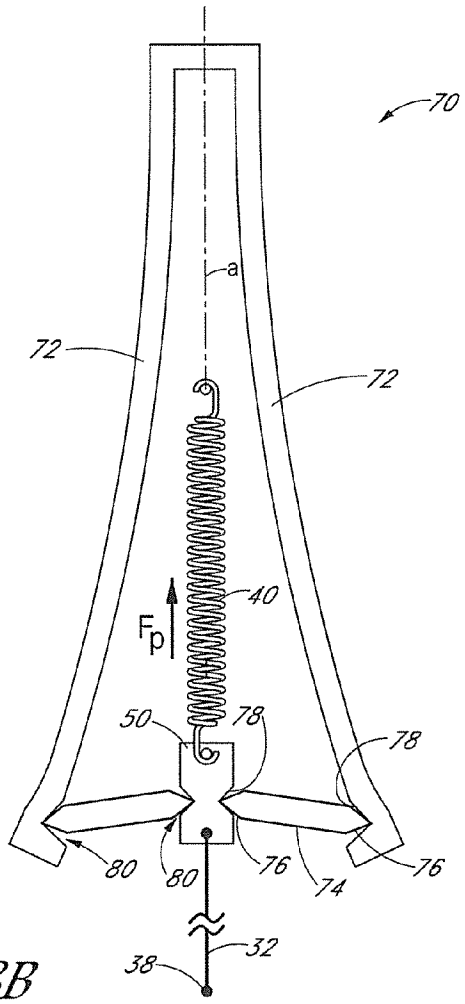
FIGS. 8A and 8B show schematic representations of a spring arrangement in accordance with still another embodiment, shown at two positions.
Figure 8A:
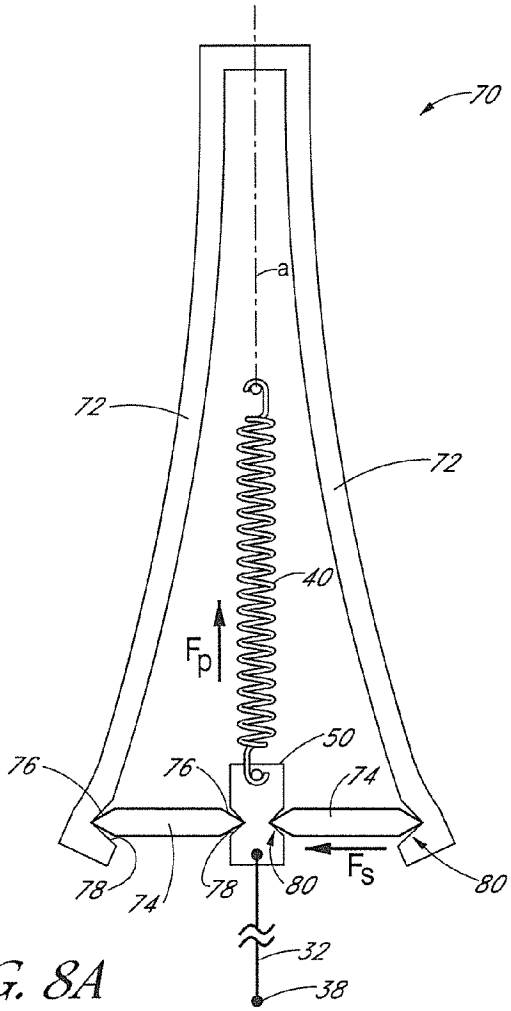

With reference next to FIG. 8A, another embodiment of a spring tension structure 70 configured in accordance with one embodiment follows theoretical behavior similar to that illustrated schematically in FIG. 6.

As shown in FIG. 8A, a primary spring 40 is attached at a fixed end to a fixed mount 38. A movable end 44 of the primary spring 40 attaches to a carrier 50 that preferably is constrained to move axially. The carrier 50 in turn attaches to a wire or string 32 so that the primary spring 40 is coaxially aligned with and applies tension to the string 32, and a change in tension provided by the primary spring 40 varies in accordance with the function −kx. In this embodiment a secondary spring assembly comprises a pair of oppositely-arranged cantilevered bars (bar springs) 72 that act as linear-flex springs. Each bar spring 72 connects to the carrier 50 via a connector bar before that has opposing knife-edge ends 76 that are received into corresponding knife-edge receivers 28 formed in the carrier 50 and the bar spring 72. The knife-edge ends 76 and receivers 78 form joints 80 on either end so as to minimize rotational friction as the carrier 50 moves relative to the bar springs 72, and the connector bars 74 correspondingly rotate.

FIG. 8A depicts the device 70 in an arrangement in which α=0°. In operation, as the wire or string 32 elongates (see FIG. 8B) the carrier 50 moves axially (such as a distance x), and the connectors 74 thus rotate, and in a manner as discussed above the secondary spring force Fs provided by the bar springs 72 develops a non-zero axial component Fsa, with each bar spring 72 providing half of this force, and communicating the force Fsa through the connector bars 74 to the carrier. Preferably the bar springs 72 are selected so that Fsa approximates kx over the operational range of α.

Figure 9B:
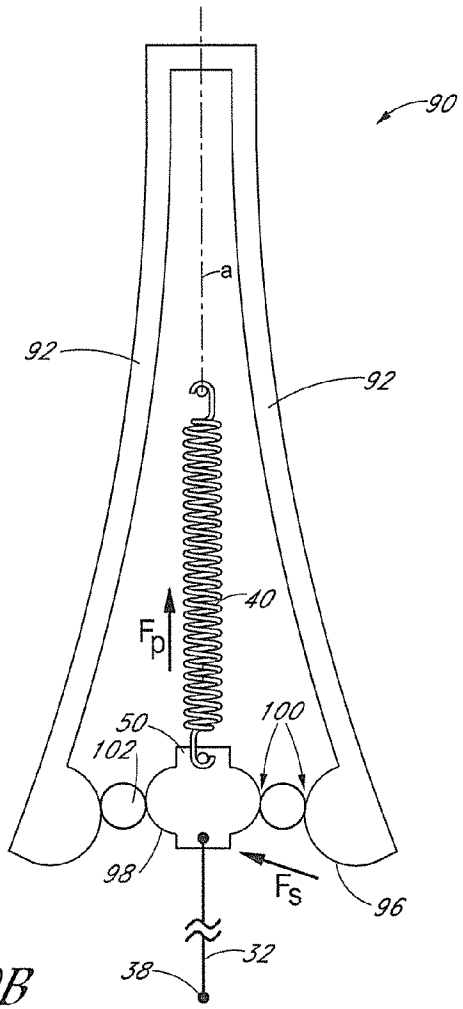
FIGS. 9A and 9B show schematic representations of still another embodiment of a spring arrangement shown at two positions.
Figure 9A:
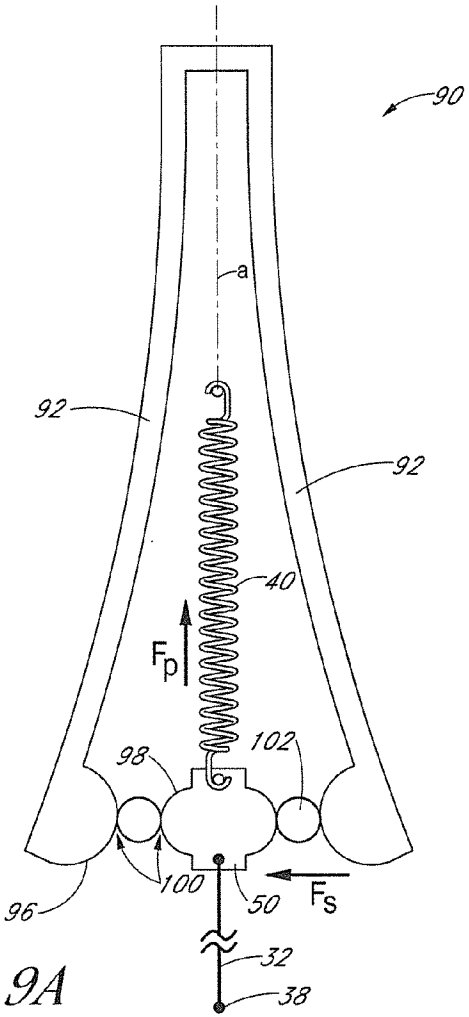

FIGS. 9A-B depict another embodiment 90 in which bar springs 92 supply a secondary force. In FIGS. 9A-B, the bar springs 92 have a curved surface 96 at a joint 100 (such as a semicircular-shaped surface) and the carrier 50 also has a curved surface 98 at a carrier joint 100 (such as a semicircular-shaped surface). A bearing 102, such as a spherical ball-bearing, is interposed between each bar spring and carrier curved joint surface 96, 98. This embodiment operates similar to the embodiments of FIGS. 6 and 8. However, as the carrier 50 moves axially, the ball bearing 102 rotates over the joint surfaces 96, 98 with very little friction. In this manner the line of action of the bar springs 92 on the carrier 50 varies along angle α as in other embodiments.

In some embodiments the curved surfaces 96, 98 can be arcuate about a fixed radius of curvature. In other embodiments the curved surfaces can have a varying radius of curvature along their lengths in order to generate a camming effect. The camming affect can be selected so as to help the associated secondary spring better approximate the linear −kx function of the primary spring by, for example, using the camming surface to create a lever arm so as to create a mechanical advantage compensating for incremental variations in the axial spring rate at particular values of α.

The carrier 50 employed in this or others of the embodiments disclosed herein can be supported in any desired manner. In some preferred embodiments it is suspended above a surface, held in place by the tension supplied by the primary spring and borne by the attached wire or string. In other embodiments it slides over the surface. In still other embodiments it is supported on the surface by a linear bearing.

Figure 10:
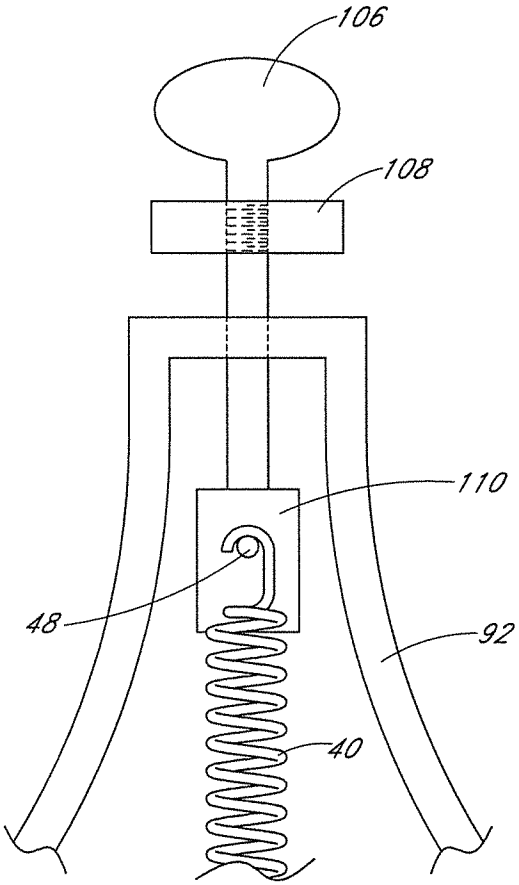
FIG. 10 is a schematic representation of features that may be employed in at least some of the embodiments described herein.

In a preferred embodiment, and with reference next to FIG. 10, preferably the fixed end of the primary spring 40 can be selectively moved in order to change an initial tension/initial primary spring length. In the illustrated embodiment, a tuning peg or knob 106 is supported by a peg frame 108 and threadingly attached to a mount carrier 110 that carries the primary spring fixed mount 48. As the tuning peg 106 is rotated the primary spring fixed end support 48 is moved. The carrier 110 also preferably moves axially, so the primary spring is elongated, thus providing more tension. Preferably the wire or string can also be tensioned so that the carrier is moved to a position at which the tension is fully provided by the primary spring.

Figure 11:
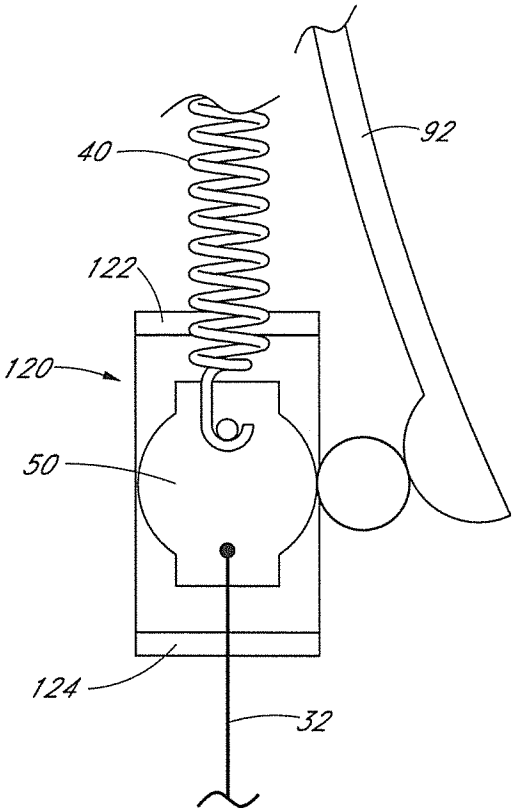
FIG. 11 is a close-up schematic view of a stop feature in accordance with one embodiment and shown in the context of a portion of the embodiment of FIG. 9.

With additional reference to FIG. 11, a stop mechanism 120 comprises first and second translation limiters 122 (or stops) that can be placed to prevent the carrier 50 from moving axially beyond a desired operational range. In some embodiments the stop mechanism is attached to a frame or other support that may support the associated tension device.

In some guitar-based embodiments a user may tension the string via the tuning peg 106 sufficient so that the carrier 50 is immediately adjacent the second stop 122 (on the string side of the carrier). As such, if the user desires to "bend" notes during play, the carrier 50 will engage the second stop, preventing the carrier 50 from moving further to compensate for the user pulling on the string 32, and thus allowing the user to increase the tension in the string, resulting in a "bent" note.

Figure 12:
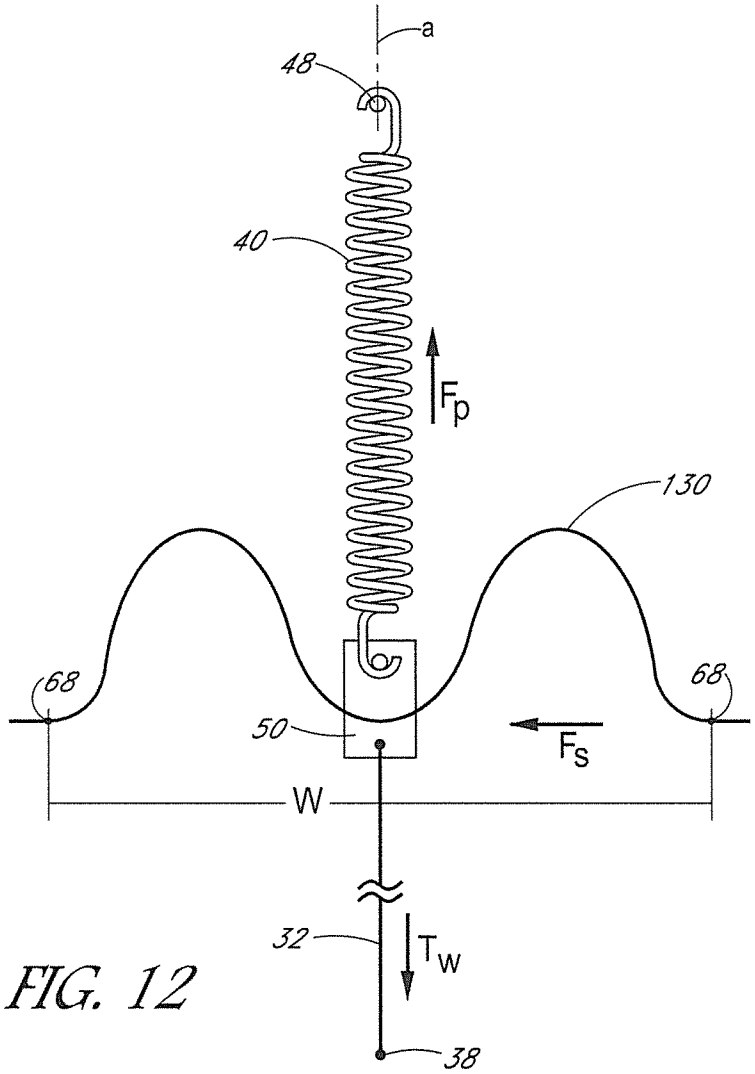
FIG. 12 is a schematic representation of a spring arrangement configured in accordance with yet another embodiment.

With reference next to FIG. 12, another embodiment is schematically represented in which a primary spring 40 that is coaxial with a string 32 comprises a coil spring held in tension and connected to the string 32 via a carrier 50 configured to move linearly along the axis a. A secondary spring 130 is constructed comprising a flat piece of spring steel having a length greater than a width w between spring mounts 68, to which the flat spring 130 is attached. A center of the flat spring 130 is also attached to the carrier 50, and the flat spring 130 is compressed so that it fits within the width of the device. As shown, due to such compression the flat sheet 130 is deflected into two symmetrical curves, one on each side of the axis. As shown in FIG. 12, each curve provides a secondary spring force Fs in compression and directed transverse to the axis. In the illustrated embodiment the secondary spring force is directed in a direction in which $\alpha=0°$. As the string lengthens or contracts, the carrier 50 will move axially, and the secondary spring force will adopt an axial component Fsa that will at least partially compensate for the change in axial force exerted by the primary spring 40 as discussed above.

Figure 13:
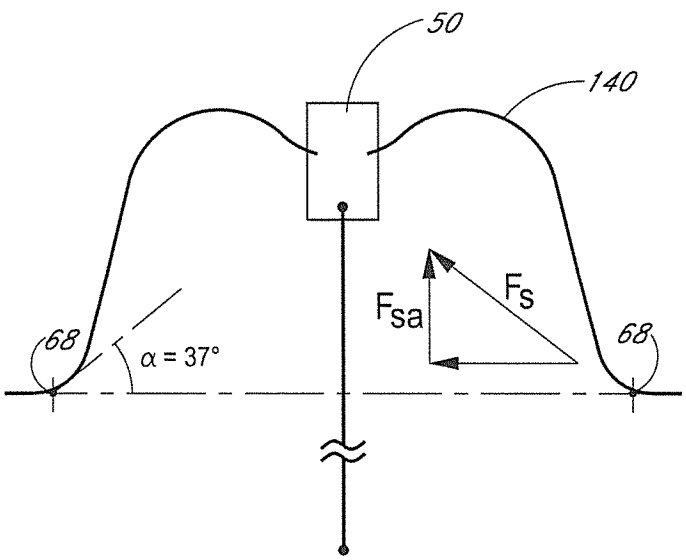
FIG. 13 is a schematic representation of a spring arrangement configured in accordance with still another embodiment.

With reference next to FIG. 13, in another embodiment, a flat spring sheet 140 of spring steel can be used to configure a tension device in with the secondary spring force is directed in a direction generally corresponding to the angle of deflection corresponding to the zero spring rate position. As discussed above in connection with FIG. 7, no primary spring is necessary in an embodiment operating around the zero spring rate position.

Figure 14:
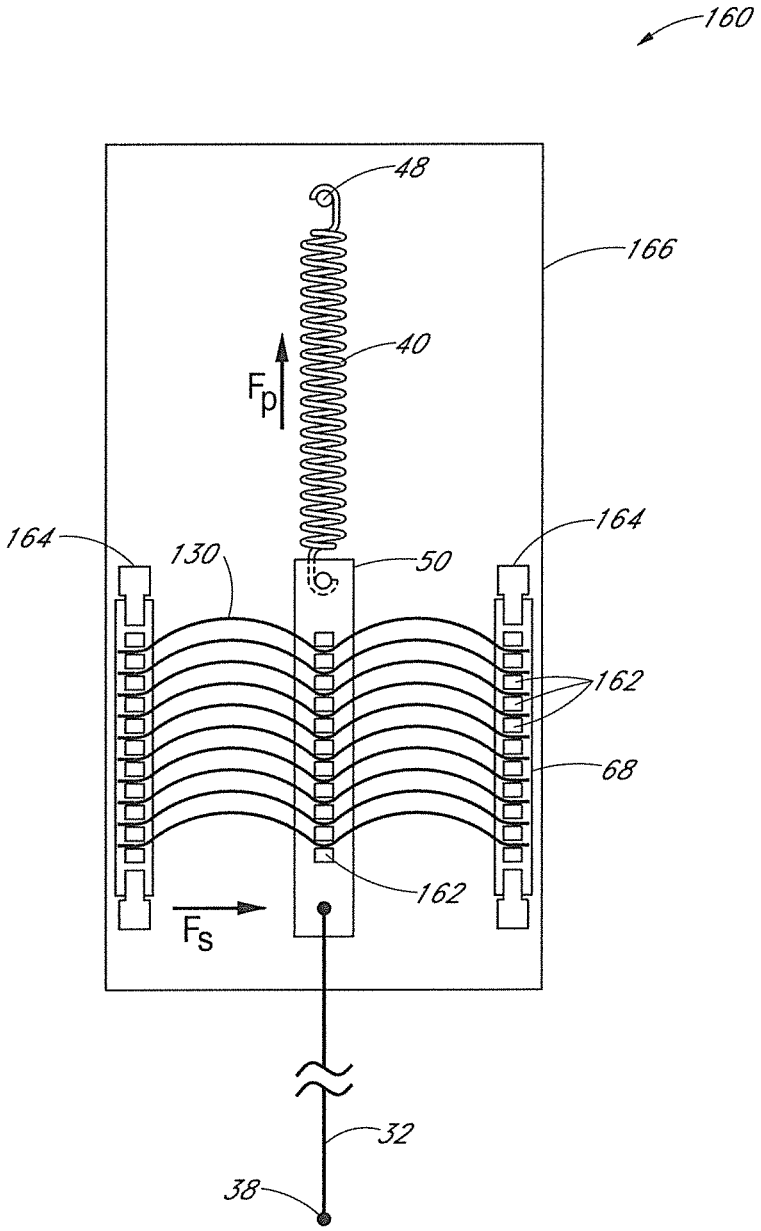
FIG. 14 shows an embodiment of a tension device employing features as in the embodiment illustrated in FIG. 12.

With reference next to FIG. 14, another embodiment is illustrated in which a tension device 160 employs a configuration resembling that of FIG. 12, except that multiple deflected flat sheets 130 are provided to, in sum, provide the desired secondary spring forces Fs. In the illustrated embodiment the fixed string mounts 68 comprises spacers 162 to keep adjacent sheets 130 of spring steel spaced from one another, but held securing with in a clamp 164 of the mount 68. Similarly, in this embodiment the carrier 50 is elongate and comprises several spacers 162 that maintain a space between adjacent sheets 130 of spring steel. A clamp disposed on the carrier 50 also can hold the springs 130 and spacers on 62 in place. In some embodiments the spacers 162 comprise flat pieces of spring steel that can be replaced as needed or desired. In another embodiment layers of spring steel can be engaged with one another.

In the embodiment illustrated in FIG. 14, the multiple deflected sheets 130 of spring steel combine to provide a desired secondary spring force Fs. In the illustrated embodiment the primary coil spring 40 has a spring rate of 91 lb./in., and the secondary spring comprises 10 half-inch wide strips 130 of 3 mil thick spring steel. Half an inch of the length of each sheet is deflected within a space of about 0.3 inch between the carrier 50 and the mount 68. The mount preferably is incorporated into a frame 166 that, in the illustrated embodiment, has a width of about 0.66 in. total, a length of about 2.3 in., and a height of about 0.665 in.

Figure 15:
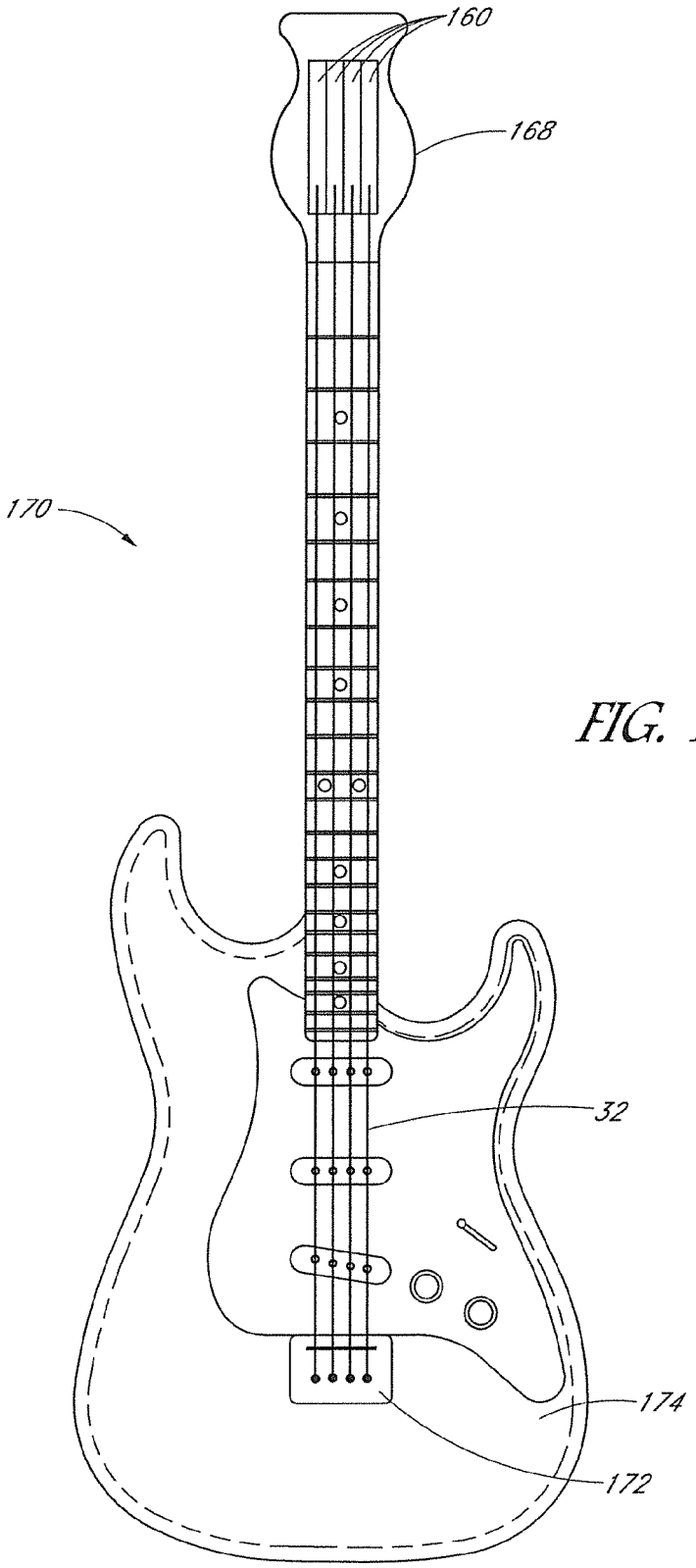
FIG. 15 shows a schematic representation of a bass guitar employing tension devices on a headstock of the guitar.

The frame width of 0.66 in. and the selected spring rate in the embodiment of FIG. 14 approximates the spacing between strings in a typical electric bass guitar, and the desired force of an example bass guitar string. Thus, with additional reference to FIG. 15, in a preferred embodiment a plurality of the tension devices 160 can be mounted side-by-side on a headstock 168 of a bass guitar 170, with each tension device 160 dedicated to providing tension to a corresponding musical string 32. One end of the string 32 is secured to a bridge 172 supported on the body 174 of the guitar 170. The other end of the string 32 is attached to a corresponding one of the tension devices 160.

In the embodiments discussed above in connection with FIGS. 12-14, the spring sheets are rigidly connected to the mounts and carrier, and thus are considered a solid-state system in which the components are not movable relative one another. As such, there is little or no external friction. Also, even if the tension device is exposed to outside elements such as dirt and grime, such elements will not substantially affect spring function. It is to be understood that embodiments employing other types of springs, including coil springs, bar springs, etc., can be configured so that the springs are rigidly connected to the mounts and carrier.

Figure 16:
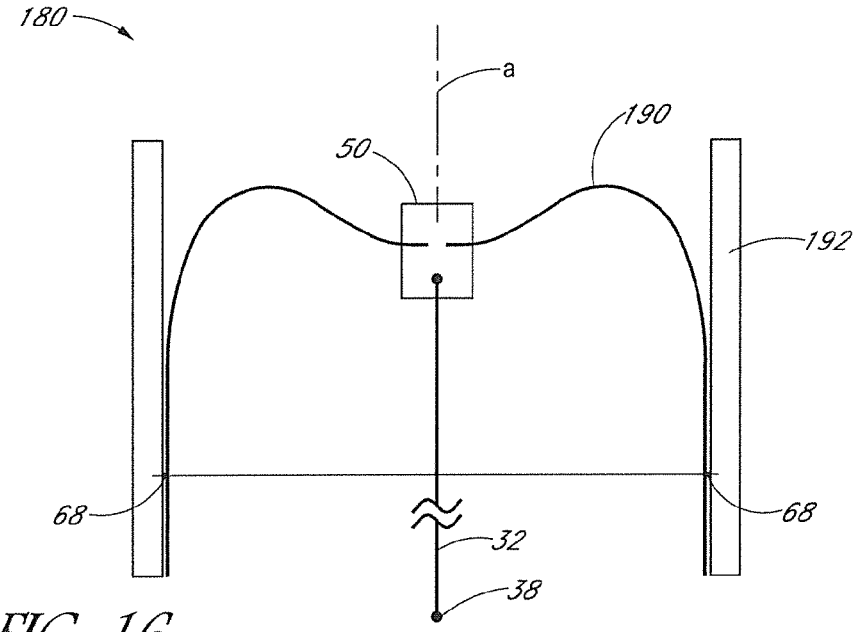
FIG. 16 is a schematic representation of a spring arrangement configured in accordance with a still further embodiment.

With reference next to FIG. 16, in another embodiment of a tension device 180, a sheet 190 of spring steel is affixed to the carrier 50 in the middle of the sheet. The spring steel sheet 190 is deflected so that outer ends of the sheet is disposed generally parallel to a side mount wall 192 of the tension device 180 and are securely held in place by a mount 68. In another embodiment, the stacked outer ends of the sheets 190 may not be held in place by a mount.

Figure 17:
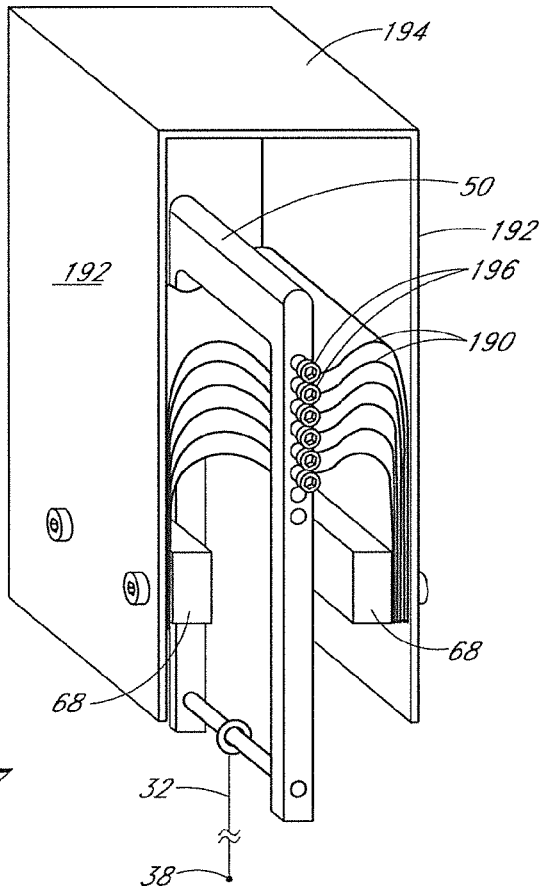
FIG. 17 shows a perspective schematic view of an embodiment of a tension device employing features as in the embodiment illustrated in FIG. 16.

With additional reference to FIG. 17, a tension device 180 having similarities to the embodiment of FIG. 16 employs a plurality of sheets 190 of spring steel that are mounted to the carrier 50 so that there is a space between each spring sheet 190. Each sheet is deflected on either side of the carrier 50, and the end of each spring steel sheet 190 sets against a mount wall 192 of a frame 194, with adjacent sheets 190 at least partially overlapping one another. A mount 68 can secure the sheets 190 to the mount wall 192. Each deflected sheet applies a transversely-directed force on each side of the carrier 50, and the forces exerted by the sheets are combined into the secondary force Fs. Each sheet 190 can be secured to the carrier 50 by being disposed below a threaded bolt 196 that extends transversely above the corresponding sheet 190 and deflects the middle of the associated sheet. In an additional embodiment each sheet can be rigidly attached to the corresponding fastener.

As noted above, embodiments of tension devices having features as described herein can be incorporated into stringed instruments such as guitars. Embodiments can function as, and be placed as, the bridge of a guitar or other stringed instrument. In other embodiments, constant-tension devices such as discussed herein can be placed on the headstock of a guitar (electric or acoustic), violin, cello or other stringed instrument, thus keeping the components spaced from the body of the instrument. Notably, suitable stringed instruments for incorporating tension devices as discussed herein also include pianos, mandolins, steel guitars, and others.

The "cent" is a logarithmic unit of measure used for musical intervals. More specifically, one cent is 1/100 of the difference in frequency from one note to the next in the 12-note chromatic scale. In this scale there are twelve notes in each octave, and each octave doubles the frequency so that 1200 cents doubles a frequency. As such, one cent is precisely equal to 2^(1/1200) times a given frequency. Since frequency is proportional to the square root of tension, one cent is also equal to a tension change by 2^((1/1200)*2)=2^(1/600) from one tension value to a tension value one cent away. 2^(1/600)−1=1/865 (0.001156). Thus, every change in tension by 1/865 (0.001156) equates to one cent different in frequency. Similarly, every change in tension by 1/86 (0.01156) equates to a ten cent difference in frequency, and every change in tension by 1/173 (0.00578) equates to a five cent difference in frequency.

In one embodiment, the operation range of the tension device configured to be used with a stringed musical instrument is selected to correspond to a change in frequency of ten cents or less per 1 mm of travel. In another embodiment, the operation range of tension device is selected to correspond to a change in frequency of five cents or less per 1 mm of travel. The actual length of the operation range can vary, but in some embodiments is up to about 1 mm of travel. In other embodiments, the operation range is up to about 1-1.5 mm of travel. In still further embodiments, the operation range is up to about 2 mm of travel.

With reference again to FIG. 6 and Table 3, in one embodiment the range of 10° from $\alpha=-5°$ to $\alpha=4°$ corresponds to a total distance of displacement of 0.175 inches and an average spring rate of 1.37 lb./in. Thus, the change in tension from one side of this range to the other is 0.24 lb., which is 0.24 lb./180 lb.=0.001332 change in tension, which corresponds to about 1.15 cents, which is well within the desired range, and is within a range that will not be aurally detectable by the human ear.

To determine a maximum desired change in tension to define a desired operational range of, for example, 10 cents, a string tension is multiplied by the value of 10 cents change infrequency. For example, for a guitar string designed for a tension of about 10 pounds, a change in tension corresponding to ten cents of frequency is calculated as 10 lb.* (01156)=0.12 lb.

It is to be understood that components of any of the embodiments discussed above, and also including embodiments not explicitly discussed above, but which include features combined to form other embodiments employing principles discussed herein, can be selected so as to construct a tension device having an operating range suitable for stringed musical instruments.

The embodiments discussed above have disclosed structures with substantial specificity. This has provided a good context for disclosing and discussing inventive subject matter. However, it is to be understood that other embodiments may employ different specific structural shapes and interactions.

Although inventive subject matter has been disclosed in the context of certain preferred or illustrated embodiments and examples, it will be understood by those skilled in the art that the inventive subject matter extends beyond the specifically disclosed embodiments to other alternative embodiments and/or uses of the invention and obvious modifications and equivalents thereof. In addition, while a number of variations of the disclosed embodiments have been shown and described in detail, other modifications, which are within the scope of the inventive subject matter, will be readily apparent to those of skill in the art based upon this disclosure. It is also contemplated that various combinations or subcombinations of the specific features and aspects of the disclosed embodiments may be made and still fall within the scope of the inventive subject matter. Accordingly, it should be understood that various features and aspects of the disclosed embodiments can be combined with or substituted for one another in order to form varying modes of the disclosed inventive subject matter. Thus, it is intended that the scope of the inventive subject matter herein disclosed should not be limited by the particular disclosed embodiments described above, but should be determined only by a fair reading of the claims that follow.

What is claimed is:

1. A tensioning device, comprising:

a primary spring attached to a carrier so as to apply a primary spring force directed along an axis, the carrier being constrained to only move along the axis, the primary spring force applied to the carrier changing in accordance with a primary spring rate function as the carrier moves relative to the primary spring along the axis;

a wire or string attached to the carrier and extending along the axis so that a net axial force applied to the carrier is applied to the wire or string; and a secondary spring having a first end attached to the carrier so as to apply a secondary spring force to the carrier, the secondary spring force directed across the axis and having an axial component that is applied to the carrier in a direction along the axis and a normal component that is applied to the carrier in a direction normal to the axis, the secondary spring force configured so that the axial component of the secondary spring force varies in accordance with a secondary spring rate function as the carrier moves relative to the primary spring along the axis;

wherein the net axial force applied to the carrier comprises the sum of the primary spring force and the axial component of the secondary spring force; and wherein the secondary spring rate function approximates and opposes the primary spring rate function as the carrier moves axially within an operating range so that the net axial force stays within a desired range about a preferred tension as the carrier moves axially within the operating range.

2. A stringed musical instrument comprising a tensioning device as in claim 1, the wire or string comprising a musical string having a first end attached to the carrier and a second end fixed relative to the carrier, wherein the secondary spring is chosen so that as the carrier moves longitudinally along the axis the axial component of the secondary spring force changes in accordance with the secondary spring rate function, and the secondary spring rate function approximates and opposes the primary spring rate function so that the net axial force applied to the carrier stays within about 1.2% of the preferred tension per millimeter of longitudinal movement.

3. A stringed musical instrument as in claim 2, wherein the secondary spring is chosen so that as the carrier moves longitudinally along the axis the axial component of the secondary spring force changes in accordance with the secondary spring rate function, and the secondary spring rate function approximates and opposes the primary spring rate function so that the net axial force applied to the carrier stays within about 0.6% of the preferred tension per millimeter of longitudinal movement.

4. A tensioning device as in claim 1, wherein a second end of the secondary spring is fixed relative to the carrier, and a secondary spring angle is defined between a line normal to the axis and a line of action of the secondary spring, and wherein the carrier operating range is defined as a distance along the axis between opposing first and second axial positions, the carrier being between the first and second axial positions.

5. A tensioning device as in claim 4 additionally comprising a first stop at the first axial position of the operating range, the first stop preventing the carrier from moving in a first direction past the first axial position.

6. A tensioning device as in claim 5 additionally comprising a second stop at the second axial position of the operating range, the second stop preventing the carrier from moving in a second direction past the second axial position.

7. A tensioning device as in claim 4, wherein the operating range corresponds to a change in the secondary spring angle of up to 10°.

8. A tensioning device as in claim 7, wherein the operating range is defined within a range in which the secondary spring angle is between ±5°.

9. A guitar comprising a tensioning device as in claim 1 mounted to one of a headstock and a bridge of the guitar, wherein a guitar string has a first end attached to the carrier and a second end attached to the other of the headstock and the bridge of the guitar, a tension in the guitar string being equal to the net axial force applied to the carrier.

10. A guitar as in claim 9, wherein the carrier is movable to a position at which the guitar string is held at a perfect tune tension, and wherein as the guitar string elongates the axial force applied to the carrier by the primary spring decreases and the axial component of force applied to the carrier by the secondary spring in the direction the carrier moves as the string elongates.

11. A guitar as in claim 9, wherein a second end of the secondary spring is fixed relative to the carrier, and a secondary spring angle is defined between a line normal to the axis and a line of action of the secondary spring, and wherein the carrier operating range is defined as a distance along the axis corresponding to a change in the secondary spring angle of up to 10°, and wherein the primary spring has a primary spring rate and the secondary spring has an axial spring rate component that opposes the primary spring rate so that a change in tension in the guitar string within the operating range corresponds to a range of 10 cents or less of frequency.

12. A tensioning device as in claim 1, wherein the secondary spring comprises a pair of springs acting on opposite sides of the carrier, second ends of the secondary springs being fixed relative to the carrier.

13. A tensioning device as in claim 12, wherein the secondary springs are rigidly connected to the carrier and a fixed secondary spring mount.

14. A tensioning device as in claim 13, wherein the secondary springs comprise a flat sheet deflected in compression.

15. A tensioning device as in claim 14, comprising a plurality of the flat sheets spaced apart from one another.

16. A tensioning device as in claim 12, wherein the pair of springs comprise deflected bars.

17. A tensioning device as in claim 16 additionally comprising a connector between each deflected bar and the carrier.

18. A tensioning device as in claim 17, wherein the connector comprises an elongate bar.

19. A tensioning device as in claim 17, wherein the connector comprises a ball bearing.

20. A constant tension device, comprising:

a carrier configured to be movable along an axis;

a wire or string attached to the carrier and extending along the axis so that an axial force applied to the carrier is communicated to the wire or string;

a target tension defined as a desired tension for the wire or spring; and a spring having a first end attached to the carrier and a second end attached to a spring mount that is fixed relative to the carrier so that the spring applies a spring force to the carrier, a spring angle defined between a line normal to the axis and a line of action of the spring, the spring force directed transverse to the axis and having an axial force component and an axial spring rate that are communicated to the carrier in a direction along the axis;

wherein the spring is selected so that the axial force component is at the target tension when the spring angle is a zero rate angle at which the axial spring rate of the spring is zero.

21. A constant tension device as in claim 20, wherein when the spring angle is greater than the zero rate angle the axial spring rate is one of negative or positive, and when the spring angle is less than the zero rate angle the axial spring rate is the other of negative or positive.

22. A tensioning device as in claim 12, wherein the pair of springs exert equal and opposite spring forces on the carrier, and the equal and opposite spring forces constrain the carrier to move only along the axis.

* * * * *